US007823593B2

(12) United States Patent
Gueret

(10) Patent No.: US 7,823,593 B2
(45) Date of Patent: Nov. 2, 2010

(54) PACKAGING AND APPLICATOR DEVICE FOR A COSMETIC OR ANOTHER CARE PRODUCT

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1150 days.

(21) Appl. No.: 10/779,725

(22) Filed: Feb. 18, 2004

(65) Prior Publication Data

US 2004/0182410 A1 Sep. 23, 2004

Related U.S. Application Data

(60) Provisional application No. 60/461,810, filed on Apr. 11, 2003.

(30) Foreign Application Priority Data

Feb. 24, 2003 (FR) ..... 03 02253

(51) Int. Cl.
*A45D 40/26* (2006.01)
*A46B 5/02* (2006.01)

(52) U.S. Cl. ..... 132/218; 132/320; 15/144.1

(58) Field of Classification Search ..... 132/218, 132/313, 320; 401/126–130; 15/143.1, 144.1, 15/172, 134.1; 16/430, 438, 900
See application file for complete search history.

(56) References Cited

U.S. PATENT DOCUMENTS

| | | | | | |
|---|---|---|---|---|---|
| 397,028 | A * | 1/1889 | Shay | 132/290 |
| 963,749 | A * | 7/1910 | Deats et al. | 132/290 |
| 1,357,679 | A * | 11/1920 | Ball | 132/290 |
| 2,666,222 | A * | 1/1954 | Gordon | 15/185 |
| 3,164,856 | A * | 1/1965 | Samaras et al. | 401/190 |
| 4,165,755 | A | 8/1979 | Cassai | |
| 4,370,989 | A * | 2/1983 | Taylor | 132/317 |
| 4,732,287 | A * | 3/1988 | Bennett | 215/49 |
| 4,922,575 | A * | 5/1990 | Riemann | 16/430 |
| 5,137,038 | A * | 8/1992 | Kingsford | 132/218 |
| 5,391,011 | A * | 2/1995 | Gueret | 401/126 |
| 5,815,875 | A * | 10/1998 | Yamada | 15/167.1 |
| 5,894,847 | A * | 4/1999 | Gueret | 132/218 |
| 6,026,823 | A * | 2/2000 | Gueret | 132/218 |
| 6,073,298 | A * | 6/2000 | O'Brien | 15/160 |
| 6,220,254 | B1 | 4/2001 | Gueret | |
| 6,237,609 | B1 * | 5/2001 | Vasas | 132/218 |
| 6,760,949 | B2 * | 7/2004 | Kaminstein et al. | 15/164 |
| 2002/0039513 | A1 | 4/2002 | Pink | |
| 2003/0015211 | A1 | 1/2003 | Bouix et al. | |

FOREIGN PATENT DOCUMENTS

| | | |
|---|---|---|
| DE | 296 14 364 U 1 | 11/1996 |
| DE | 199 18 587 A 1 | 11/2000 |
| JP | U-60-61165 | 4/1985 |
| JP | U-60-113711 | 8/1985 |
| JP | U-61-161231 | 10/1986 |
| JP | A-11-222274 | 8/1999 |
| JP | A-2001-161434 | 6/2001 |

* cited by examiner

*Primary Examiner*—Rachel R Steitz
(74) *Attorney, Agent, or Firm*—Oliff & Berridge, PLC

(57) ABSTRACT

An applicator includes a base portion carrying an applicator element, and a handle portion rotably mounted on the base portion to turn about a fixed axis of rotation. The handle portion may have a longitudinal axis. The axis of rotation and the longitudinal axis of the handle portion may not be mutually perpendicular.

38 Claims, 6 Drawing Sheets

PACKAGING AND APPLICATOR DEVICE FOR A COSMETIC OR ANOTHER CARE PRODUCT

This application claims the benefit of French Application No. 03 02253 filed on Feb. 24, 2003 and of U.S. Provisional Application No. 60/461,810 filed on Apr. 11, 2003, the entire disclosures of which are incorporated by reference herein.

FIELD OF INVENTION

The present invention relates to packaging and applicator devices for a cosmetic or other care products.

BACKGROUND

French patent application FR 2,701,196 describes a device for applying a substance. The device comprises a receptacle and an applicator. The applicator comprises both a closure cap having a base portion suitable for being fixed onto the receptacle, and a loop hinged relative to the base portion about a hinge axis that is perpendicular to the longitudinal axis of the receptacle and to the longitudinal axis of the loop.

SUMMARY OF THE INVENTION

Exemplary embodiments of the invention provide a device having improved ergonomics while having a relatively simple construction.

Exemplary embodiments of the invention provide an applicator comprising: a base portion carrying an applicator element; and a handle portion rotably mounted on the base portion to turn about a fixed axis of rotation. The handle portion may have a longitudinal axis, with the fixed axis of rotation and the longitudinal axis of the handle portion being arranged to not be mutually perpendicular.

In exemplary embodiments, the axis of rotation and the longitudinal axis are not parallel. The longitudinal axis may extend obliquely relative to the axis of rotation, for example.

In exemplary embodiments, the axis of rotation and the longitudinal axis may intersect.

In exemplary embodiments, by turning the handle portion relative to the base portion, a user may modify an angle formed between an axis of the base portion and the longitudinal axis of the handle portion.

Exemplary embodiments of the invention enable make-up, for example, to be applied using various hand movements depending on the desired effect. Further, exemplary embodiments may enable the angle of attack of the applicator element, such as, for example, the angle of attack of a mascara brush, to be modified during application.

For example, embodiments of the invention make it possible to apply make-up to the left eye or to the right eye while using the same hand movements, for example, when the applicator element is not circularly symmetrical.

In exemplary embodiments, the axis of the base portion is not perpendicular to the axis of rotation.

In exemplary embodiments, the base portion may serve as a closure cap for a receptacle. The base portion may be arranged, for example, to be fixed onto a neck of the receptacle, such as, for example, by being screwed onto the neck. The base portion may include fixing means for fixing onto a receptacle, for example, a screw thread. Such fixing means may be leaktight or leakproof.

The base portion and the handle portion may advantageously co-operate in such a manner as to enable a user to secure or lock the handle portion in at least one predefined positions relative to the base portion. In embodiments, the user may be enabled to secure or lock the handle portion in at least two predefined positions relative to the base portion.

The handle portion and the base portion may, for example, co-operate so as to produce a click sound and/or to generate a hard point of resistance when such a predefined position is reached.

The handle portion and the base portion may advantageously be arranged in such a manner that a user may turn the base portion relative to the handle portion using one hand only. For example, the user may take hold of the base portion between the user's thumb and the user's index finger, with the handle portion being held by the user's other fingers against the palm of the user's hand.

At least one of the base portion and the handle portion may have, on an outside thereof, at least one portion in relief. Such a portion in relief may reduce slipping, and may comprise, for example, one or more of bumps, ridges, grooves and cells.

At least one of the base portion and the handle portion may also include a coating of, or may be made at least in part of, a material that provides a good grip. For example, the material may be a non-slip material, such as an elastomer.

The base portion may include a surface that is inclined relative to the axis of the base portion, and against which the handle portion bears. The surface may be substantially planar. The surface may extend perpendicularly to the axis of rotation.

The hinge between the base portion and the handle portion may be achieved in various ways.

The hinge may, for example, be arranged in such a manner that while the applicator is being used, the handle portion maintains a direction relative to the base portion as given to the handle portion by a user.

Such a result may be obtained by having sufficient friction created by contact between the base portion and the handle portion.

In exemplary embodiments, alternatively or additionally, at least one portion in relief, such as, for example, a step or other suitable portion in relief, may be disposed on at least one of facing surface of the base portion and/or the handle portion. This may make it easier for a user to secure or lock the handle portion in a predefined angular position relative to the base portion.

The base and handle portions may be assembled together in various ways. For example, the base and handle portions may be assembled together by snap-fastening, hot or cold snapping (like a rivet), riveting, or clamping.

At least one of the base portion and the handle portion may include a pin that is engaged in a housing of the other one of the base portion and the handle portion.

The pin may be snap-fastened, snapped like a rivet, riveted, or clamped in the housing.

For example, the base portion may include such a pin that projects from the above-described inclined surface. The pin may comprise several parts. For example, the pin may be split. The pin may be provided with a step at one end so as to be snap-fastened through a corresponding opening of the handle portion.

When the pin is on the base portion, the base portion may, for example, be used as a closure cap for a receptacle, without compromising the sealing of the closure, or complicating the achievement of such sealing.

The handle portion may include an insert that enables the handle portion to be fixed onto the base portion by snap-fastening. The insert may be fixed inside a piece that defines an outside surface of the handle portion. The piece may have, for example, a single opening at one end. The insert may be put into place through the single opening.

It should be understood that the handle portion may also be made with a pin arranged to be fixed, for example, snap-fastened, in a corresponding opening of the base portion.

The handle portion may include grooves and/or recesses. The handle portion may, for example, include fins and a body to which the fins are connected. The body may include a housing in which there is engaged a pin secured to the base portion.

In exemplary embodiments of the invention, the applicator may include a stem carrying, at one end, the applicator element. The stem may be secured at its other end to the base portion. The axis of the stem may coincide with the axis of the base portion. The applicator element may be fixed to the stem in a removable manner.

At least one of the base portion and the handle portion may include at least one marker, such as, for example, graduations. The other one of the base portion and the handle portion may include an index so as to enable a user to identify an annular position of the handle portion relative to the base portion.

Exemplary embodiments of the invention provide an applicator comprising: a base portion having an axis and carrying an applicator element; and a handle portion rotably mounted on the base portion to turn about an axis of rotation. The axis of rotation and the axis of the base portion may not be mutually perpendicular.

Exemplary embodiments of the invention provide an applicator comprising: a base portion carrying an applicator element, the base portion including fixing means for fixing onto a receptacle; and a handle portion rotably mounted on the base portion to turn about an axis of rotation.

Exemplary embodiments of the invention provide an applicator comprising: a base portion carrying an applicator element; and a handle portion rotably mounted on the base portion to turn about a fixed axis of rotation. The handle portion may have a longitudinal axis and the axis of rotation and the longitudinal axis of the handle portion may not be mutually perpendicular. The applicator element may be configured for applying a product on lips, eyelids, eyelashes, eyebrows and/or hairs.

Exemplary embodiments of the invention provide an applicator comprising: a base portion having an axis and carrying an applicator element; and a handle portion rotably mounted on the base portion to turn about a fixed axis of rotation. The handle portion may have a longitudinal axis with an angle between the axis of the base portion and the axis of the handle portion being less than, for example, strictly inferior to, 90° when the handle portion is rotated about the axis of rotation.

Exemplary embodiments of the invention provide a packaging and applicator device comprising: an applicator as defined above; and a receptacle onto which the applicator may be fixed in a removable manner.

The receptacle may include a wiper member arranged to wipe the applicator element while the applicator is being removed.

Exemplary embodiments of the applicator according to the invention may make it quite easy to obtain a leaktight or leakproof closure of the receptacle without degrading the quality of the wiping.

Exemplary embodiments of the invention provide a method of applying a cosmetic or other care product on a portion of the face or of the body, for example, on lips, eyelids, eyelashes, eyebrows and/or hair, the method comprising: loading an applicator element, which may be of any type, with a substance, such as a cosmetic, the applicator element being secured to a base portion that is turnable relative to a handle portion about an axis of rotation which is not perpendicular and, in addition, is preferably not parallel to the longitudinal axis of the handle portion; and between different application modes, modifying a direction of the base portion relative to the handle portion.

When the applicator element is disposed at an end of a stem secured to the base portion, and when the applicator element is arranged to apply a substance onto keratinous fibers, such as, for example, eyelashes and/or eyebrows, the method may comprise: applying the substance, such as make-up, to keratinous fibers with the stem substantially horizontal, for example, and with a first inclination of the stem relative to the axis of the handle portion, the first inclination being substantially zero, for example; applying the substance, such as make-up, to keratinous fibers with the stem substantially vertical, and with a second inclination of the stem relative to the handle portion, different from the first, for example, a maximum inclination of the stem relative to the axis of the handle portion.

For example, during the first application step it may be possible to turn the stem about its axis, which may be useful when the applicator element comprises a brush. In the second application step, the substance, such as make-up, may be applied with the brush, but without turning the stem about its axis.

When the applicator element is not rectilinear and has a free end that is offset to one side relative to the axis of the stem, the handle portion and the base portion may be arranged in such a manner that when the axis of the handle portion makes a maximum angle with the axis of the stem, the handle portion extends to the same side as the free end of the applicator element. This may make application easier.

BRIEF DESCRIPTION OF THE DRAWINGS

The invention will be better understood on reading the following detailed description of non-limiting embodiments thereof, and on examining the accompanying drawings, in which.

DETAILED DESCRIPTION OF EXEMPLARY EMBODIMENTS

Figure 1:
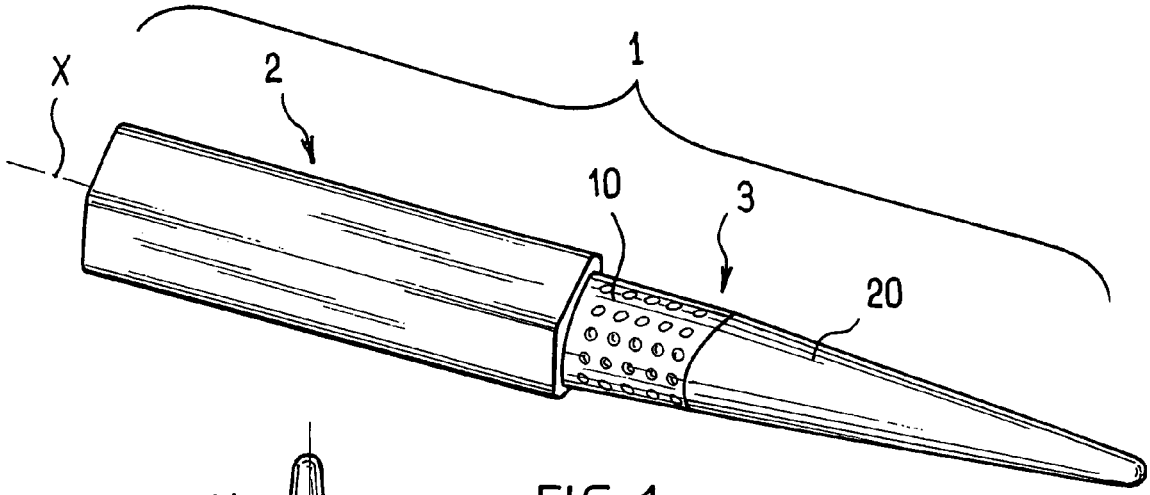
FIG. 1 is a diagrammatic perspective view of a packaging and applicator device according to an exemplary embodiment of the invention.

The term "care products" is used to generically refer to any substance that is used to effect one or more external body conditions, such as conditions of the skin, hair and nails. For example, such substances include, but are not limited to, treatment products, such as sunscreen, moisturizer and/or medicaments, cleansing products and cosmetic products, such as makeup products, or any other known or later developed product that may be applied to the body.

FIGS. 1-4 show a device 1 comprising a receptacle 2 having a longitudinal axis X, and an applicator 3 that is capable of being fixed in a removable manner on the receptacle 2.

The applicator 3 may include a base portion 10 having an axis Z, and a handle portion 20 having an axis Y. The handle portion may be capable of turning relative to the base portion 10 about an axis of rotation R that forms a non-zero angle $\alpha$ with the axis Y. The axis R may be fixed relative to the base portion.

An angle $\beta$ between the axis Z of the base portion and the axis Y of the handle portion may be, for example, always strictly inferior to 90° when the handle portion 20 is rotated about the axis of rotation R.

The receptacle 2 may contain a substance P, for example, a care product, such as a cosmetic, for example, mascara. In the case of mascara, the applicator 3 may include a stem 4 that extends along the axis Z of the base portion 10. The stem 4 may be provided at a bottom end 4*a* with a brush 5.

The brush 5 may be of any type and may, for example, comprise a conventional twisted core 6 with bristles trapped between the branches of the core 6.

For example, the stem 4 may be secured at a top end 4*b* by an insert 7 disposed inside the base portion 10.

Figure 22:
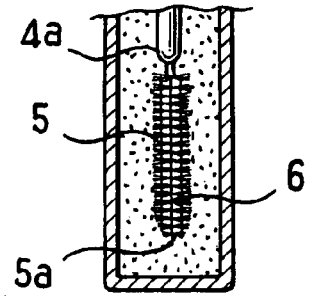
FIG. 22 is a diagrammatic and fragmentary longitudinal cross-section view of another exemplary embodiment of the invention.

In the exemplary embodiment of FIGS. 1-4, the core 6 is not rectilinear, such that the distal end 5*a* of the brush 5 is not in alignment with the axis Z. However, it should be understood that other arrangements are contemplated, such as when the core 6 is rectilinear and when the distal end 5*a* of the brush 5 is in alignment with the axis Z, as shown in FIG. 22, for example.

Figure 4:
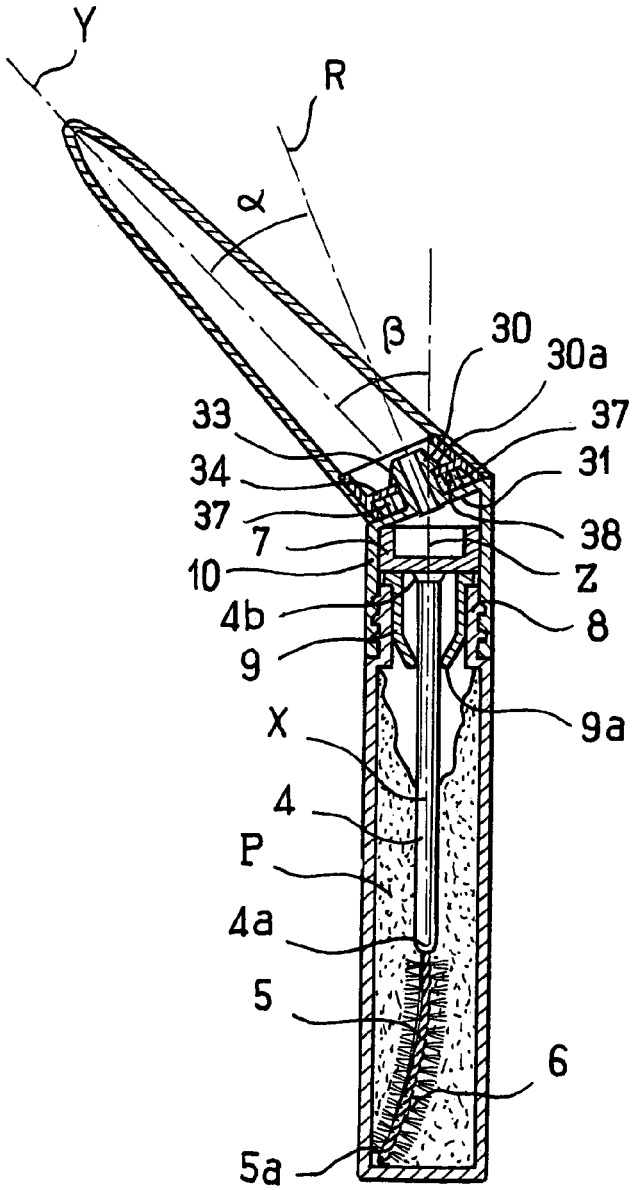
FIG. 4 is a diagrammatic longitudinal cross-section view of the device of FIG. 3.

The receptacle 2 may be provided with a neck 8 having the axis X and an outside thread. Fixed in the neck 8 may be an elastomer wiper member 9 having one end 9*a* that defines a circular opening arranged to press against the stem 4. The base portion 10 may comprise fixing means for fixing onto the receptacle. For example, in the exemplary embodiment shown, the fixing means may be an inside thread having the axis Z, thereby enabling the base portion 10 to be screwed onto the neck 5 such that the axes X and Z coincide. As shown in FIG. 4, the wiper member 9 may cover a top edge of the neck 8 and may thus contribute to obtaining a sealed closure for the receptacle 2 when the insert 7 comes to bear on the top edge of the neck once the base portion 10 has been screwed onto the receptacle 2.

The base portion 10 may comprise other fixing means for fixing onto the receptacle.

The base portion 10 may, for example, be fixed on the receptacle 2 by friction and/or snap-fastening. To this end, the base portion 10 may, for example, comprise a groove configured to cooperate with a corresponding bead of the neck 8 of the receptacle 2.

The fixing means may be leaktight or leakproof.

Portions in relief 10*a*, such as, for example, cells, may be provided on an outside surface of the base portion 10 so as to make the base portion 10 easier to grip. Alternatively or additionally, the base portion 10 may include an elastomer coating, which may be overmolded, for example. The base portion 10 may also be made integrally, i.e., monolithically, in a material that provides a good grip, such as an elastomer.

In the exemplary embodiment shown in FIG. 4, the direction of the stem 4 relative to the axis Z of the base portion 10 is constant. However, the stem 4 could be articulated relative to the base portion 10, for example, by a ball-and-socket joint.

Figure 2:
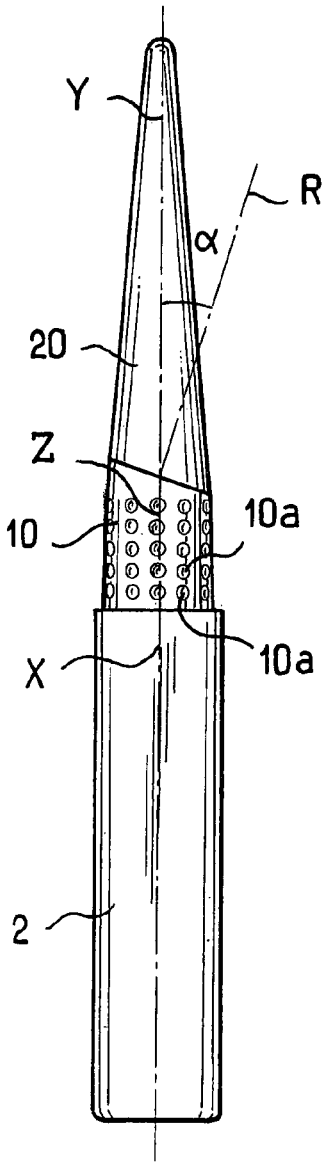
FIG. 2 is an elevation view of the device of FIG. 1 with the handle portion being in alignment with the base portion.
Figure 3:
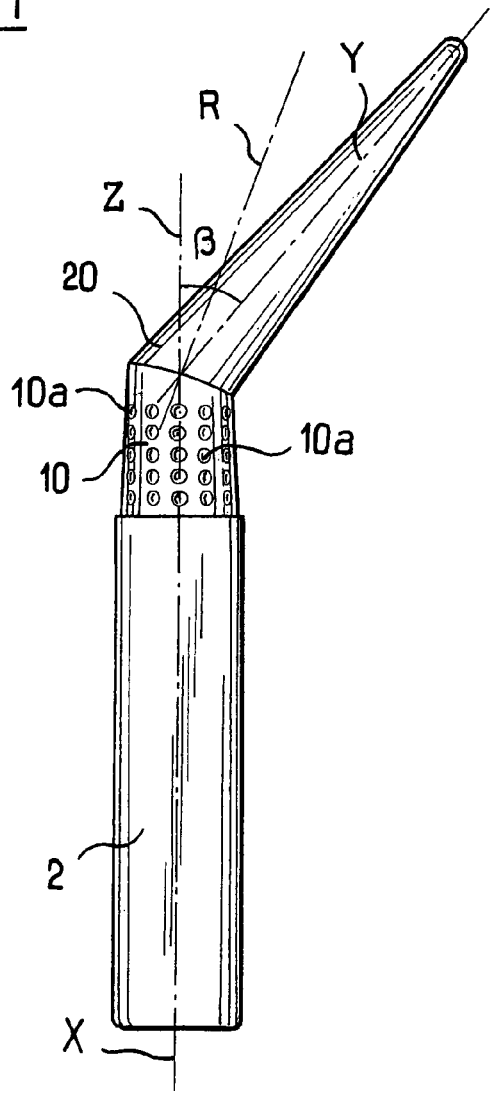
FIG. 3 is an elevation view of the device of FIG. 1, analogous to FIG. 2, with the handle portion being turned through half a turn relative to the base portion.

By mounting the handle portion 20 to be rotatable relative to the base portion 10, and by inclining the axis of rotation R, it is possible, by turning the handle portion 20 through half a turn about the axis R, to pass from a position shown in FIG. 2, in which the longitudinal axis Y of the handle portion 20 is in alignment with the axis Z, to a position shown in FIG. 3, in which the axis Y forms the angle $\beta$ with the axis Z.

The handle portion 20 may be mounted on the base portion 10 in various ways.

In the exemplary embodiment of FIGS. 1 to 4, mounting is achieved by a pin 30 that projects from an inclined surface 31 of the base portion 10, with the handle portion 20 being engaged on the pin 30. The handle portion 20 may include an insert 34 provided with a circular opening 33 inside which the pin 30 may be retained, for example, by snap-fastening, via a step 30*a* formed in an end of the pin 30. The inclined surface 31 may extend generally perpendicularly to the axis R. The inclined surface 31 may form a join plane between the base portion 10 and the handle portion 20.

The inclination of the surface 31 relative to the axis Z influences the maximum angle $\beta$ that may be obtained.

Advantageously, tabs 37 may be provided on the base portion 10 to project from the surface 31 so as to co-operate with a portion in relief 38 of the insert 34. This arrangement may generate a click sound and/or a hard point of resistance as the handle portion is positioned in one of various predetermined positions, for example, as shown in FIGS. 2 and 3.

The pin 30 may be made in any suitable way. For example, the pin 30 may be split axially, as shown in FIG. 5.

Figure 5:
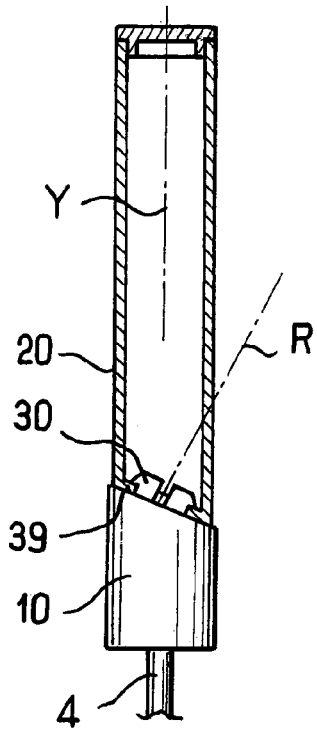
FIG. 5 is a diagrammatic and fragmentary axial cross-section view of another exemplary embodiment of the invention.

As shown in FIG. 5, the handle portion 20 may comprise a circularly cylindrical body about the axis Y. The body may be provided at a bottom end thereof with a rim 39 onto which the pin 30 may be snap-fastened.

As shown, the cylindrical body of the handle portion 20 may be closed at a top end thereof by a closure member.

Various exemplary embodiments of a hinge according to the invention are described below with reference to FIGS. 6 to 11.

Figure 6:
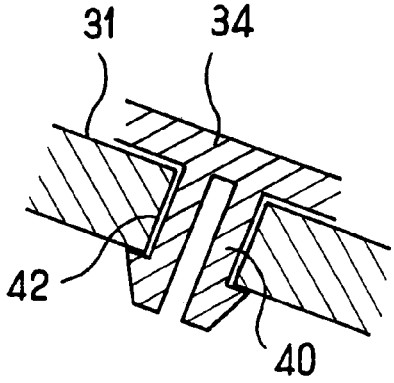
FIG. 6 is a diagrammatic and fragmentary axial cross-section view showing the handle portion with a pin that is capable of being snap-fastened in the base portion.

The handle portion 20 may include a pin arranged to be snap-fastened in a corresponding opening of the base portion, for example, as shown in FIG. 6. As shown in FIG. 6, the handle portion 20 may include a split pin 40, extending from the insert 34, for example, that is capable of being snap-fastened in a circular opening 42, through the inclined surface 31, for example, of the base portion 10.

Figure 7:
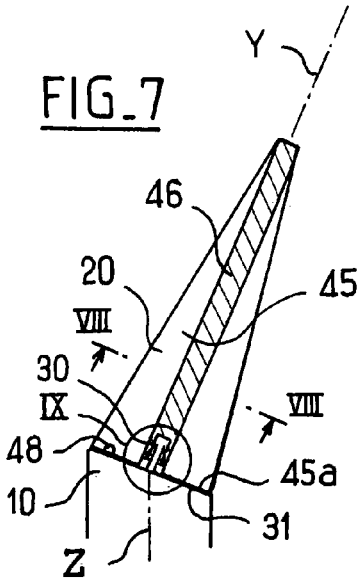
FIG. 7 is a diagrammatic and fragmentary axial cross-section view, analogous to FIG. 5, showing another way of mounting the handle portion on the base portion.
Figure 8:
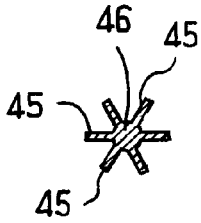
FIG. 8 is a cross-section view along section VIII-VIII of FIG. 7.
Figure 9:
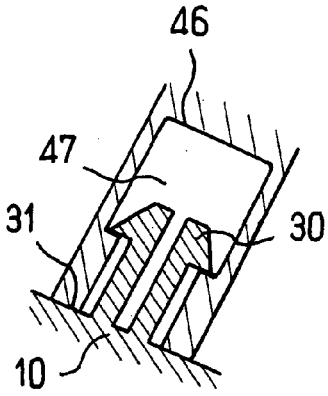
FIG. 9 is an enlarged scale view of the detail IX of FIG. 7.

The handle portion 20 may include fins 45, as shown in FIGS. 7 and 8, for example. The fins 45 may be connected to a body 46 which may include, at a bottom end, a housing 47 into which the pin 30 may be snap-fastened. This is illustrated in more detail in the enlarged view of FIG. 9.

The fins 45 may come to bear, via bottoms 45*a* thereof, against the inclined surface 31 of the base portion 10, so as to provide resistance to rotation of the handle portion 20 relative to the base portion 10.

Where necessary or desired, the base portion 10 may include at least one bump 48 which may be sensed by a user each time a fin 45 passes over the bump 48. This may make it easy, where necessary or desired, for the user to position the handle portion in a desired position. The handle portion 20 may be mounted on the base portion 10 with a small amount of clearance, so as to make it easier to rotate a fin 45 past such a positioning portion in relief.

Figure 10:
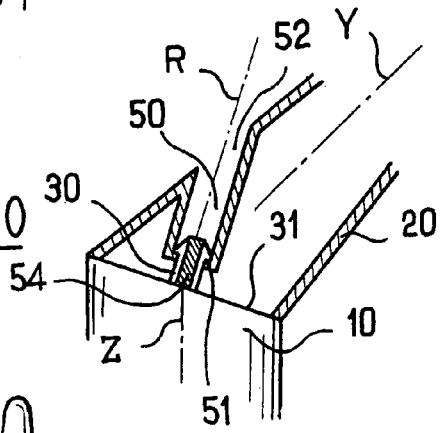
FIGS. 10 and 11 are diagrammatic and fragmentary longitudinal cross-section views of various exemplary embodiments of the hinge between the handle portion and the base portion according to the invention.

As shown in FIG. 10, the handle portion 20 may also be made as a single piece with a housing 50 that is provided at one end with a rim 51 onto which the pin 30 may be snap-fastened. The housing 50 may open to the outside via an opening 52. Where necessary or desired, the opening 52 may be closed, for example, by a closure member (not shown).

The pin 30 may be split and a locking peg 54 may be engaged therewith.

Figure 11:
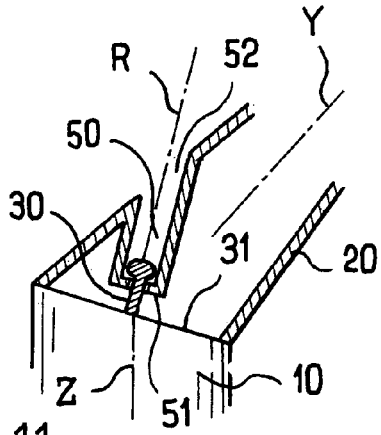

The pin 30 may also have an end snapped like a rivet, for example, as shown in FIG. 11.

Figure 12:
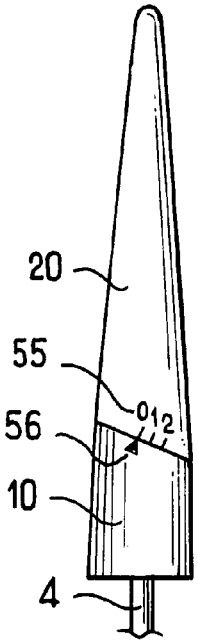
FIGS. 12 and 13 are diagrammatic and fragmentary elevation views of various exemplary embodiments of the applicator according to the invention.

The handle portion 20 and the base portion 10 may, for example, as shown in FIG. 12, include graduations 55 on one and an index mark 56 on the other. This may enable a user to identify accurately the angular direction of the handle portion 20 relative to the base portion 10.

Figure 13:
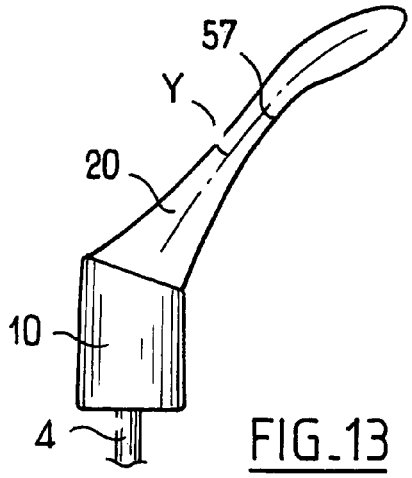

The handle portion 20 may be made with various shapes other than the shapes shown in the foregoing figures. For example, FIG. 13 shows a handle portion 20 that is not circularly symmetrical about the axis Y. The handle portion 20 has at least one concave edge 57.

Figure 14:
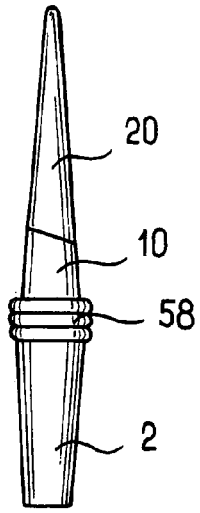
FIG. 14 is an elevation view of a device according to another exemplary embodiment of the invention.

The receptacle 2 may comprise something other than a cylindrical body. For example, FIG. 14 shows a receptacle 2 comprising a generally frustoconical body, flaring upward. At a top end, the receptacle 2 may be provided with an add-on part 58 that includes a threaded neck and carries a wiper member, for example, comprising a block of foam.

The packaging and applicator device of FIGS. 1 to 4 may be used as follows, for example.

Figure 15:
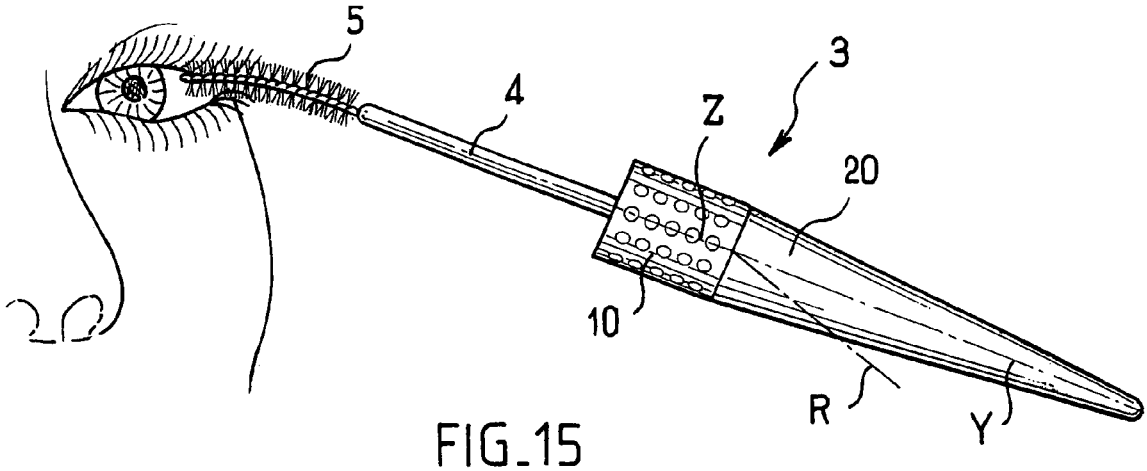
FIG. 15 is an elevation view illustrating how make-up may be applied to eyelashes using the applicator of FIGS. 1 to 3, with the handle portion being substantially in alignment with the base portion.

While the axes Z and Y are substantially in alignment, a user may apply a substance, such as make-up, to eyelashes with the stem 4 substantially horizontal, as shown in FIG. 15. Where necessary or desired, the brush 5 may be caused to revolve, so as to make it easy for eyelashes to penetrate between the bristles of the brush 5 and for the substance to be smoothed onto eyelashes.

Figure 16:
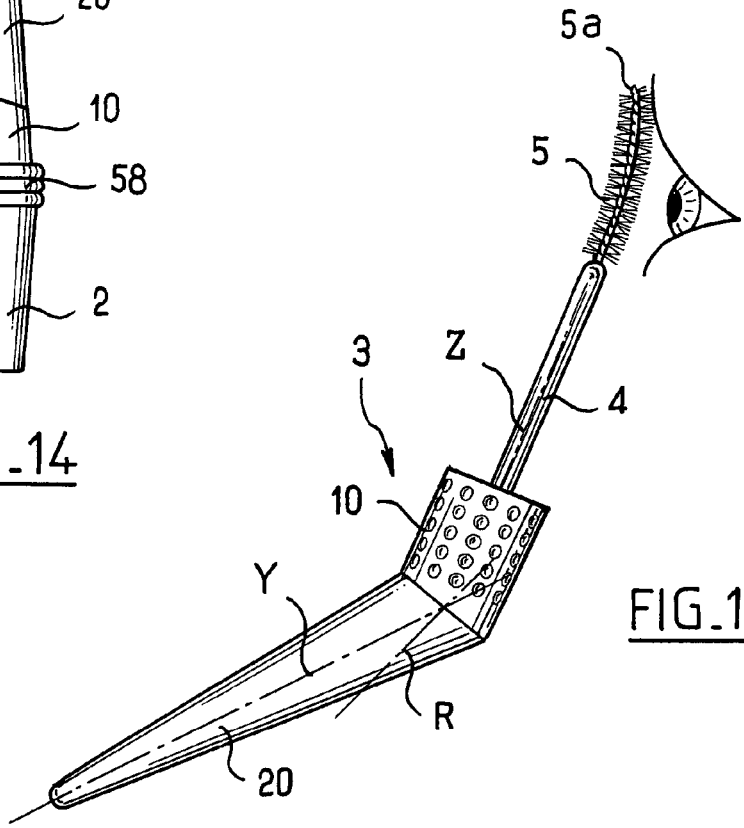
FIG. 16 is an elevation view illustrating how make-up may be applied to eyelashes using the applicator of FIGS. 1 to 3, with the handle portion being turned through 180° relative to the base portion.

The user may then apply the substance to eyelashes with the end of the brush 5, for example, to separate eyelashes, once the handle portion 20 has been turned through 180° relative to the base portion 10, in such a manner that the angle β formed between the axes Z and Y is at a maximum. The user may thus use the brush 5 with the stem 4 substantially vertical, as shown in FIG. 16. As shown in FIG. 16, the free end 5*a* of the brush 5 is situated on the same side as the handle portion 20.

Figure 17:
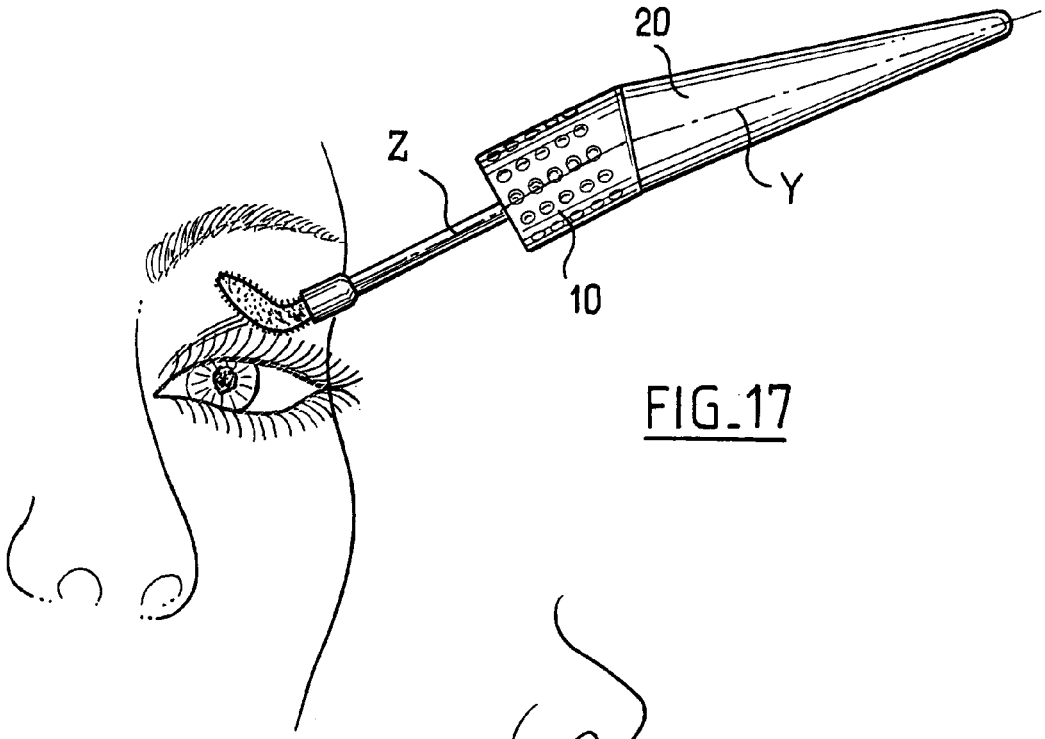
FIG. 17 is an elevation view illustrating how make-up may be applied to eyelids using another exemplary device according to the invention.
Figure 18:
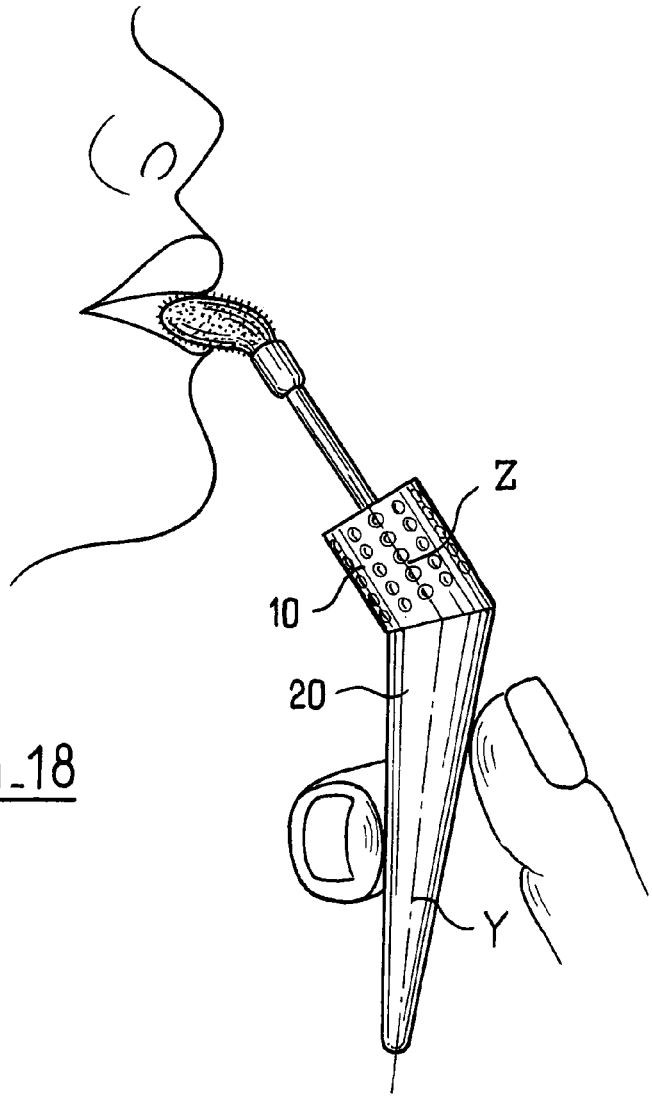
FIGS. 18 and 19 are elevation views illustrating how make-up may be applied to lips using another exemplary device according to the invention.
Figure 19:
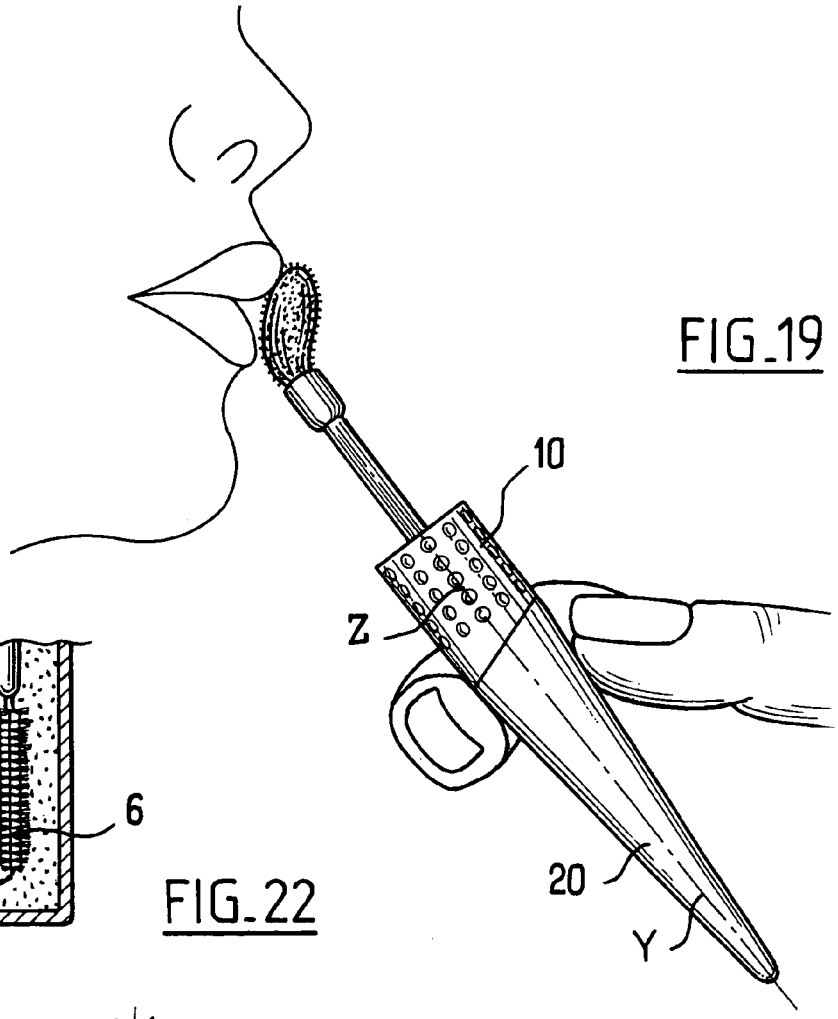

It should be understood that the invention is not limited to applying make-up to eyelashes and/or eyebrows, and an applicator in accordance with the invention may be used, for example, for applying make-up to eyelids, as shown in FIG. 17, or to lips, as shown in FIGS. 18 and 19. As shown in FIG. 18, that the angle between the axes Y and Z may be at a maximum while applying make-up to a bottom lip. As shown in FIG. 19, the angle between the axes Y and Z may be at a minimum while applying make-up to a top lip.

Figure 20:
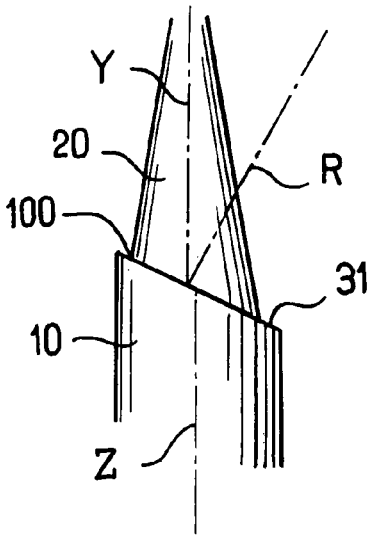
FIG. 20 is a diagrammatic and fragmentary elevation view of a connection between the handle portion and the base portion according to another exemplary embodiment of the invention.

As shown in FIG. 20, the handle portion 20 may be made in such a manner that the handle portion is not a continuation of the base portion 10. For example, a shoulder 100 may be formed at the connection between the handle portion 20 and the base portion 10. Such an arrangement makes it possible, for example, for the axes Z and R not to intersect at the inclined surface 31. In the embodiment shown in FIG. 20, an outside diameter of the base portion 10 is greater than an outside diameter of an adjacent end of the handle portion 20. In exemplary embodiments, the axes Y and R may not intersect at the inclined surface 31.

Figure 21:
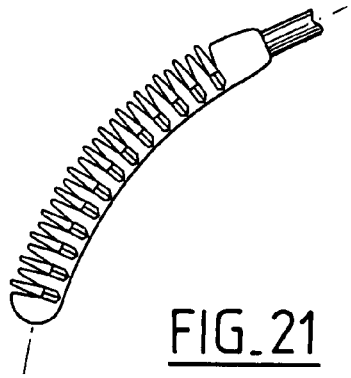
FIG. 21 is a diagrammatic and fragmentary elevation view of an exemplary applicator element comprising a comb.

The applicator element may include flocking on a surface thereof. The applicator element may comprise a comb, for example, as shown in FIG. 21, a brush having a non-twisted core, or an element with capillary retention. The applicator element may be made of a cellular and/or elastomer material, such as, for example, a foam.

The device may be designed to enable the device to be placed in a microwave oven, so as to raise the temperature of the substance, where necessary or desired.

All the characteristics of the various exemplary embodiments of the invention described above may be combined together as necessary or desired.

The base portion 10, as well as the handle portion 20, may be of anon-circular section, such as, for example, oval or prismatic.

Throughout the description, the term "comprising a" should be understood as being synonymous with "comprising at least one", unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. An applicator comprising:

a base portion carrying an applicator element and configured for fixing onto a receptacle; and a handle portion rotatably mounted on the base portion to turn about a fixed axis of rotation, the handle portion having a longitudinal axis, wherein the axis of rotation and the longitudinal axis of the handle portion are never mutually perpendicular, the axis of rotation and the longitudinal axis are not parallel, and wherein the base portion and the handle portion cooperate in such a manner as to enable a user to secure the handle portion in at least two predefined application positions relative to the base portion.

2. An applicator according to claim 1, wherein the axis of rotation and an axis of the base portion are not mutually perpendicular.

3. An applicator according to claim 1, wherein the base portion and the handle portion co-operate in such a manner as to enable a user to secure the handle portion in at least one predefined position relative to the base portion.

4. An applicator according to claim 1, wherein the handle portion and the base portion co-operate so as to produce a click sound when a predefined position of the handle portion relative to the base portion is reached.

5. An applicator according to claim 1, wherein the base portion comprises a closure cap for a receptacle.

6. An applicator according to claim 5, wherein the base portion is arranged to be fixed onto a neck of the receptacle.

7. An applicator according to claim 1, wherein the base portion is configured to be fixed on the receptacle by at least one of snap-fastening, screwing and friction.

8. An applicator according to claim 1, wherein the handle portion and the base portion are arranged in such a manner that a user may turn the base portion relative to the handle portion using only one hand.

9. An applicator according to claim 1, wherein at least one of the base portion and the handle portion has, on an outside thereof, at least one portion in relief.

10. An applicator according to claim 1, wherein at least one of the base portion and the handle portion is made at least in part out of a material that provides a good grip.

11. An applicator according to claim 1, wherein at least one of the base portion and the handle portion is made at least in part out of a non-slip material.

12. An applicator according to claim 1, wherein the base portion includes a surface that is inclined relative to the axis of the base portion, and against which the handle portion bears, the axis of rotation extending substantially orthogonally to the inclined surface.

13. An applicator according to claim 1, wherein at least one portion in relief is disposed on at least one facing surface of at least one of the base portion and the handle portion, the at least one portion in relief being configured to facilitate securing the handle portion in a predefined angular position relative to the base portion.

14. An applicator according to claim 1, wherein at least one of the base portion and the handle portion includes a pin which is engaged in a housing of the other one of the base portion and the handle portion.

15. An applicator according to claim 14, wherein the base portion includes a pin.

16. An applicator according to claim 15, wherein the pin is provided with a step at one end to be snap-fastened through a corresponding opening of the handle portion.

17. An applicator according to claim 14, wherein the pin is split.

18. An applicator according to claim 14, wherein the handle portion includes a pin arranged to be snap-fastened in a corresponding opening of the base portion.

19. An applicator according to claim 14, wherein the handle portion includes fins and a body to which the fins are connected, the body including a housing in which there is engaged a pin that is secured to the base portion.

20. An applicator according to claim 14, wherein the handle portion includes a cylindrical body provided at one end with a rim onto which a pin secured to the base portion is to be snap-fastened.

21. An applicator according to claim 1, wherein the handle portion includes an insert that enables the handle portion to be fixed onto the base portion by snap-fastening.

22. An applicator according to claim 1, wherein at least one of the base portion and the handle portion includes at least one marker, and the other one of the base portion and the handle portion includes an index so as to enable a user to identify an annular position of the handle portion relative to the base portion.

23. An applicator according to claim 1, including a stem having a first end and a second end, the stem carrying, at the first end, the applicator element, and being secured at the second end to the base portion.

24. An applicator according to claim 23, wherein the applicator element comprises a brush.

25. An applicator according to claim 24, wherein the brush includes a non-rectilinear core.

26. An applicator according to claim 1, wherein the applicator element comprises at least one of a flexible endpiece, a flocked endpiece, a foam and a comb.

27. An applicator according to claim 1, wherein the applicator element is connected in a removable manner to the base portion.

28. An applicator according to claim 1, wherein the applicator element has a free end that is offset to one side relative to an axis of the applicator element, the free end being situated on a same side as the handle portion when an angle between the axes of the base portion and the handle portion is at a maximum.

29. An applicator according to claim 1, wherein the base portion includes fixing means for fixing onto a receptacle.

30. An applicator according to claim 29, wherein said fixing means are leaktight.

31. A packaging and applicator device, comprising:

an applicator according to claim 1; and a receptacle onto which the applicator is to be fixed in a removable manner.

32. A device according to claim 31, wherein the receptacle includes a wiper member arranged to wipe the applicator element while the applicator is being removed.

33. An applicator comprising:

a base portion having an axis and carrying an applicator element, the base portion being configured for fixing onto a receptacle; and a handle portion rotatably mounted on the base portion to turn about a fixed axis of rotation, the handle portion having a longitudinal axis;

wherein an angle between the axis of the base portion and the axis of the handle portion is always strictly inferior to 90° when the handle portion is rotated about the axis of rotation, the axis of rotation and the longitudinal axis are not parallel, and wherein the base portion and the handle portion cooperate in such a manner as to enable a user to secure the handle portion in at least two predefined application positions relative to the base portion.

34. A method of applying a substance on a portion of one of the face and the body, the method comprising:

loading an applicator element with substance, the applicator element being secured to a base portion that is turnable relative to a handle portion about an axis of rotation which is never perpendicular to the longitudinal axis of the handle portion and wherein the axis of rotation and the longitudinal axis are not parallel; and between two different application modes, modifying a direction of the base portion relative to the handle portion.

35. The method of claim 34, wherein the substance comprises a care product.

36. The method of claim 35, wherein the substance comprises a cosmetic.

37. The method of claim 34, further comprising applying the substance on at least one of lips, eyelids, eyelashes, eyebrows and hair.

38. An applicator comprising:

a base portion carrying an applicator element and configured for fixing onto a receptacle; and a handle portion rotatably mounted on the base portion to turn about a fixed axis of rotation, the handle portion having a longitudinal axis;

wherein the axis of rotation and the longitudinal axis of the handle portion are not mutually perpendicular and not parallel;

wherein the applicator element is configured for applying a product on at least one of lips, eyelids, eyelashes, and eyebrows, and wherein the base portion and the handle portion cooperate in such a manner as to enable a user to secure the handle portion in at least two predefined application positions relative to the base portion.

* * * * *